US010556156B1

(12) United States Patent
Lambo

(10) Patent No.: US 10,556,156 B1
(45) Date of Patent: Feb. 11, 2020

(54) HIGH STRENGTH RACQUET STRING

(71) Applicant: Anthony P. Lambo, West Bend, WI (US)

(72) Inventor: Anthony P. Lambo, West Bend, WI (US)

( * ) Notice: Subject to any disclaimer, the term of this patent is extended or adjusted under 35 U.S.C. 154(b) by 0 days.

(21) Appl. No.: 16/402,418

(22) Filed: May 3, 2019

Related U.S. Application Data

(60) Provisional application No. 62/691,241, filed on Jun. 28, 2018.

(51) Int. Cl.

| | |
|---|---|
| ***A63B 51/02*** | (2015.01) |
| ***D02G 3/38*** | (2006.01) |
| ***D02G 3/36*** | (2006.01) |
| ***D04C 1/12*** | (2006.01) |
| *A63B 102/02* | (2015.01) |
| *A63B 102/04* | (2015.01) |
| *A63B 102/06* | (2015.01) |

(52) U.S. Cl.
CPC ..... *A63B 51/02* (2013.01); *D02G 3/36* (2013.01); *D02G 3/38* (2013.01); *D04C 1/12* (2013.01); *A63B 2102/02* (2015.10); *A63B 2102/04* (2015.10); *A63B 2102/065* (2015.10); *A63B 2209/00* (2013.01); *D10B 2401/063* (2013.01); *D10B 2507/00* (2013.01)

(58) Field of Classification Search
CPC ... D02G 3/36; D02G 3/38; D04C 1/12; A63B 51/02
See application file for complete search history.

(56) References Cited

U.S. PATENT DOCUMENTS 4,510,934 A * 4/1985 Batra ..... A61B 17/06 428/377
4,886,691 A * 12/1989 Wincklhofer .... A41D 19/01511 428/68
5,145,172 A 9/1992 Takashima
5,327,714 A * 7/1994 Stevens ..... A63B 51/02 273/DIG. 6
5,718,159 A * 2/1998 Thompson ..... A61F 2/06 623/1.53
6,227,094 B1 * 5/2001 Taylor ..... D04C 1/06 87/8
6,460,321 B1 * 10/2002 Koshimae ..... A63B 51/02 57/210

(Continued)

*Primary Examiner* — Shaun R Hurley
(74) *Attorney, Agent, or Firm* — Donald J. Ersler

(57) ABSTRACT

A high strength racquet string includes a monofilament core and a plurality of strands braided around the monofilament core in opposite directions. The same number of strands are braided clockwise as braided counterclockwise. The plurality of strands are not bonded to the monofilament core along a length thereof, but are bonded to each other at opposing ends to prevent unraveling of the plurality of strands. A coating is not applied to the high strength racquet string. A cross-sectional shape of the monofilament core and the plurality of strands is preferably round or substantially round. The monofilament core is preferably fabricated from nylon, polyester, polyethylene or any other suitable material. The plurality of strands are preferably fabricated from Spectra, Vectran or any other suitable material. An outside diameter of the high strength racquet string preferably ranges from 1.0 mm to 1.5 mm.

14 Claims, 1 Drawing Sheet

(56) References Cited

U.S. PATENT DOCUMENTS

| | | | | |
|---|---|---|---|---|
| 6,592,617 | B2 * | 7/2003 | Thompson | A61F 2/06 623/1.53 |
| 6,634,968 | B2 * | 10/2003 | Yeh | A63B 51/02 473/524 |
| 6,716,234 | B2 * | 4/2004 | Grafton | A61B 17/06166 606/228 |
| 8,522,473 | B2 * | 9/2013 | Nakanishi | A01K 91/00 43/44.98 |
| 2006/0032460 | A1 * | 2/2006 | Hurwitz | A01K 27/006 119/795 |
| 2015/0121833 | A1 * | 5/2015 | Vandrovcova | D07B 1/185 57/202 |
| 2015/0320026 | A1 * | 11/2015 | Toddes | D04C 1/12 43/44.98 |
| 2017/0273288 | A1 * | 9/2017 | Lepage | A01K 91/12 |

* cited by examiner

HIGH STRENGTH RACQUET STRING

CROSS-REFERENCES TO RELATED APPLICATIONS

This is a non-provisional application taking priority from provisional application No. 62/691,241 filed on Jun. 28, 2018.

BACKGROUND OF THE INVENTION

1. Field of the Invention

The present invention relates generally to sporting equipment and more specifically to a high strength racquet string, which includes the unexpected result of reducing vibration after striking a ball.

2. Discussion of the Prior Art

U.S. Pat. No. 5,145,172 to Takashima discloses a string for racket. However, the Takashima reference does not teach or suggest braiding an even number of strands in opposite directions around a monofilament core. The high strength racquet string possesses higher strength, higher abrasion resistance, and improved durability relative to the prior art.

Accordingly, there is a clearly felt need in the art for a high strength racquet string, which includes braiding a plurality of even number of strands around a monofilament core in opposite directions; the unexpected result of reducing vibration after striking a ball; improved durability; improved control when striking a ball; and increased spin induced into the ball after striking thereof.

SUMMARY OF THE INVENTION

The present invention provides a high strength racquet string, which includes braiding a plurality of even number of strands around a monofilament core in opposite directions. Provisional application No. 62/691,241 is hereby incorporated by reference in its entirety. The high strength racquet string includes a monofilament core and a plurality of strands braided around the monofilament core in opposite directions. The same number of strands are braided clockwise as braided counterclockwise. A preferable number of strands range from 2 to 16. The plurality of strands are not bonded to the monofilament core and are capable of moving relative to, or independently of the monofilament core. However, the plurality of strands and the monofilament core are preferably bonded to each other at opposing ends to prevent unraveling of the plurality of strands. A coating is not normally applied to the high strength racquet string. However, a coating with color or a coating with an abrasive could be applied to the outer perimeter of the plurality of strands. A cross-sectional shape of the filament core and the plurality of strands is preferably round or substantially round. The monofilament core is preferably fabricated from nylon, polyester, polyethylene or any other suitable material. The plurality of strands are preferably fabricated from Spectra, Vectran or any other suitable material. An outside diameter of the high strength racquet string preferably ranges from 1.0 mm to 1.5 mm, but other outside diameters may also be used.

The high strength racquet string possesses higher strength, higher abrasion resistance, and improved durability relative to the prior art. The high strength racquet string could be used as string in tennis racquets, racquetball, badminton, squash racquets, or any other sporting device that requires high strength and abrasion resistance string.

Accordingly, it is an object of the present invention to provide a high strength racquet string, which includes braiding a plurality of even number of strands around a monofilament core in opposite directions; the unexpected result of reducing vibration after striking a ball; improved durability; improved control when striking a ball; and increased spin induced into a ball struck by the high strength racquet string.

These and additional objects, advantages, features and benefits of the present invention will become apparent from the following specification.

DETAILED DESCRIPTION OF THE PREFERRED EMBODIMENTS

Figure 1:
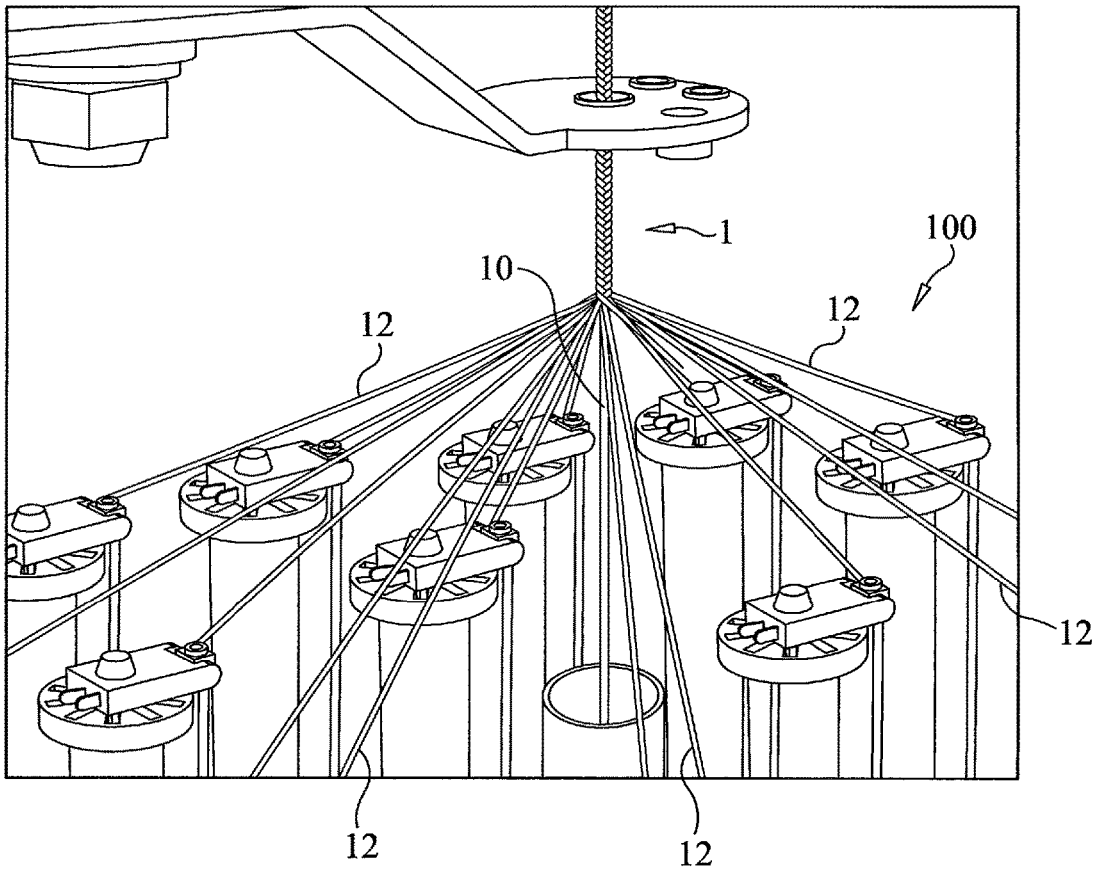
FIG. 1 is a perspective view of a high strength racquet string being wound on a carrier braider in accordance with the present invention.
Figure 2:
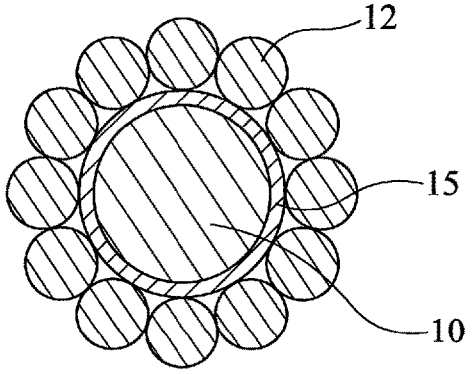
FIG. 2 is a cross sectional view of a plurality of strands adhered to a monofilament core of a high strength racquet string in accordance with the present invention.

With reference now to the drawings, and particularly to FIG. 1, there is shown a perspective view of a high strength racquet string 1 being wound on a carrier braider 100. The high strength racquet string 1 includes a monofilament core 10 and a plurality of strands 12 braided around the monofilament core 10 in opposite directions. The same number of strands 12 are braided clockwise as braided counterclockwise. A preferable number of strands 12 range from 2 to 16. The plurality of strands 12 are not bonded to the monofilament core 10 and are capable of moving relative to, or independent of the monofilament core 10, along a length of the monofilament core 10. The movement of the plurality of strands 12 includes radial and axial movement. With reference to FIG. 2, the plurality of strands 12 and the monofilament core 10 are secured or bonded to each other with an appropriate substance or process 15 at opposing ends to prevent unraveling of the plurality of strands 12. A coating is not normally applied to the high strength racquet string 1. However, a coating with color or a coating with an abrasive could be applied to the outer perimeter of the plurality of filaments 12. The abrasive would change the return of a ball or the like. A cross-sectional shape of the monofilament core 10 and the plurality of strands 12 is preferably round or substantially round. The monofilament core 10 is preferably fabricated from nylon; polyester; Ultra High Molecular Weight Polyethylene (UHMWPE); other polyethylene based materials, such as HMPE, HPPE or HMWP; or any other suitable material. The plurality of strands 12 are preferably fabricated from SPECTRA, VECTRAN or any other suitable material. SPECTRA is a registered trademark of Honeywell. VECTRAN is a registered trademark of Kuraray Co., Ltd. of Japan. An outside diameter of the high strength racquet string 1 preferably ranges from 1.0 mm to 1.5 mm, but other outside diameters may also be used.

The following parameters are given by way of example and not by way of limitation. Satisfactory results have been found, when a 66 nylon is used for the monofilament 10; the monofilament 10 has a diameter of 0.030 inches; the plurality of strands 12 each have a denier of 215; and the diameter of the high strength racquet string 1 is 0.040 inches. A wall thickness of the plurality of strands 12 is about 17 percent of a diameter measurement of the monofilament 10.

The high strength racquet string 1 possesses higher strength, higher abrasion resistance, and improved durability relative to the prior art. The high strength racquet string could be used as string in tennis racquets, racquetball, badminton, squash racquets, or any other sporting device that requires high strength and abrasion resistance string.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A high strength racquet string for retention on a sports racquet comprising:

a monofilament core; and a plurality of strands are braided around said monofilament core, said plurality of strands are an even number, the same number of said plurality of strands are braided in a clockwise direction as in a counterclockwise direction, said plurality of strands are structured to move relative to, or independent of said monofilament core in both radial and axial directions along a length of said monofilament core, said plurality of strands are secured to said monofilament core at opposing ends thereof, wherein said high strength racquet string reduces vibration to a user after an object is struck with the sports racket.

2. The high strength racquet string of claim 1 wherein:

said monofilament core is fabricated from nylon, polyester or polyethylene.

3. The high strength racquet string of claim 1 wherein:

said plurality of strands are fabricated from Spectra or Vectran.

4. The high strength racquet string of claim 1 wherein:

an outside diameter of said high strength racquet string ranges from 1.0 mm to 1.5 mm.

5. The high strength racquet string of claim 1 wherein:

said monofilament and said plurality of strands have a round cross section.

6. A high strength racquet string for retention on a sports racquet comprising:

a monofilament core; and a plurality of strands are braided around said monofilament core, said plurality of strands are structured to move relative to, or independent of said monofilament core in both radial and axial directions along a length of said monofilament core, said plurality of strands are secured to said monofilament core at opposing ends thereof, wherein said high strength racquet string reduces vibration to a user after an object is struck with the sports racket.

7. The high strength racquet string of claim 6 wherein:

said monofilament core is fabricated from nylon, polyester or polyethylene.

8. The high strength racquet string of claim 6 wherein:

said plurality of strands are fabricated from Spectra or Vectran.

9. The high strength racquet string of claim 6 wherein:

an outside diameter of said high strength racquet string ranges from 1.0 mm to 1.5 mm.

10. The high strength racquet string of claim 6 wherein:

said monofilament and said plurality of strands have a round cross section.

11. A high strength racquet string for retention on a sports racquet comprising:

a monofilament core; and a plurality of strands are braided around said monofilament core, said plurality of strands are structured to move relative to, or independent of said monofilament core in both radial and axial directions along a length of said monofilament core, said plurality of strands are secured to said monofilament core at opposing ends thereof, an outside diameter of said high strength racquet string ranges from 1.0 mm to 1.5 mm, wherein said high strength racquet string reduces vibration to a user after an object is struck with the sports racket.

12. The high strength racquet string of claim 11 wherein:

said monofilament core is fabricated from nylon, polyester or polyethylene.

13. The high strength racquet string of claim 11 wherein:

said plurality of strands are fabricated from Spectra or Vectran.

14. The high strength racquet string of claim 11 wherein:

said monofilament and said plurality of strands have a round cross section.

* * * * *